US007207160B2

(12) United States Patent
Baptista

(10) Patent No.: US 7,207,160 B2
(45) Date of Patent: Apr. 24, 2007

(54) VACUUM PACKAGING APPLIANCE WITH VACUUM SIDE CHANNEL LATCHES

(75) Inventor: Alexandre A. N. Baptista, Dublin, CA (US)

(73) Assignee: Sunbeam Products, Inc., Boca Raton, FL (US)

( * ) Notice: Subject to any disclaimer, the term of this patent is extended or adjusted under 35 U.S.C. 154(b) by 8 days.

(21) Appl. No.: 10/789,456

(22) Filed: Feb. 26, 2004
(Under 37 CFR 1.47)

(65) Prior Publication Data

US 2005/0050856 A1 Mar. 10, 2005

Related U.S. Application Data

(60) Provisional application No. 60/450,528, filed on Feb. 27, 2003, provisional application No. 60/450,295, filed on Feb. 27, 2003.

(51) Int. Cl.
*B65B 31/02* (2006.01)

(52) U.S. Cl. ..... 53/512; 53/405; 53/434

(58) Field of Classification Search ..... 53/510, 53/512, 405, 432, 433, 434, 52, 373.7
See application file for complete search history.

(56) References Cited

U.S. PATENT DOCUMENTS

| | | | |
|---|---|---|---|
| 1,143,579 | A | 6/1915 | Denhard |
| 2,079,069 | A | 5/1937 | Johnson |
| 2,319,011 | A | 5/1943 | Meredith |
| 2,354,423 | A | 7/1944 | Rosenberger |
| 2,421,149 | A | 5/1947 | Hard et al. |
| 2,568,226 | A | 9/1951 | Drake |
| 2,617,304 | A | 11/1952 | Conover |
| 2,749,686 | A | 6/1956 | Lorenz et al. |
| 2,778,171 | A | 1/1957 | Taunton |
| 2,899,786 | A | 8/1959 | Harker |
| 3,038,283 | A | 6/1962 | Unger |
| 3,148,269 | A | 9/1964 | Van Hartesveldt et al. |
| 3,464,256 | A | 9/1969 | Lloyd |
| 3,516,223 | A | 6/1970 | Andersen et al. |
| 3,688,463 | A | 9/1972 | Titchenal |
| 3,699,742 | A | 10/1972 | Giraudi |
| 3,928,938 | A | 12/1975 | Burrell |
| 3,962,847 | A | 6/1976 | Trudel |
| 3,965,646 | A | 6/1976 | Hawkins |

(Continued)

FOREIGN PATENT DOCUMENTS

| | | |
|---|---|---|
| EP | 0723915 A1 | 7/1996 |

(Continued)

*Primary Examiner*—Christopher Harmon
(74) *Attorney, Agent, or Firm*—Lawrence J. Shurupoff

(57) ABSTRACT

A vacuum packaging appliance for forming a hermetically sealed evacuated container. The appliance includes a lid adapted to define a vacuum chamber when moved to a closed position relative to a trough in the lower portion of the appliance. The trough in the lower portion of the appliance is removable from the lower portion of the appliance. In one embodiment, the appliance includes pneumatic latches that are used to hold the lid in a substantially fixed position relative to the lower portion of the appliance. Additionally, a single vacuum source can be used to active the pneumatic latches and the evacuate the vacuum chamber. The appliance is further adapted for connection to vacuum sealing attachments for various containers whereby the containers can be selectively evacuated.

8 Claims, 8 Drawing Sheets

U.S. PATENT DOCUMENTS 4,006,329 A 2/1977 Hellman et al.
4,008,601 A 2/1977 Woods
4,105,491 A 8/1978 Haase et al.
4,164,111 A 8/1979 Di Bernardo
4,208,902 A 6/1980 Kim et al.
4,330,975 A 5/1982 Kakiuchi
4,372,096 A 2/1983 Baum
4,541,224 A 9/1985 Mugnai
4,545,177 A 10/1985 Day
4,549,387 A 10/1985 Marshall et al.
4,561,925 A 12/1985 Skerjanec et al.
4,578,928 A 4/1986 Andre et al.
4,581,764 A 4/1986 Plock et al.
4,631,512 A 12/1986 Hishiki et al.
4,641,482 A 2/1987 Metz
4,928,829 A 5/1990 Di Bernardo
4,941,310 A 7/1990 Kristen
5,048,269 A 9/1991 Deni
5,239,808 A * 8/1993 Wells et al. ..... 53/512
5,352,323 A 10/1994 Chi
5,461,901 A 10/1995 Ottestad
5,608,167 A 3/1997 Hale et al.
5,638,664 A 6/1997 Levsen et al.
D389,847 S 1/1998 Huang
5,712,553 A 1/1998 Hallberg
5,765,608 A 6/1998 Kristen
5,784,862 A 7/1998 Germano
5,825,974 A 10/1998 Hutton
5,893,822 A 4/1999 Deni
6,058,998 A 5/2000 Kristen
6,124,558 A 9/2000 Baumeister et al.
6,256,968 B1 7/2001 Kristen
6,328,897 B1 12/2001 Leung
6,338,282 B1 * 1/2002 Gilbert ..... 73/864.34
6,467,242 B1 10/2002 Huang
6,520,071 B1 2/2003 Lanza
6,694,710 B2 2/2004 Wang
7,003,928 B2 * 2/2006 Patterson et al. ..... 53/405

FOREIGN PATENT DOCUMENTS

EP 1053945 A1 11/2000
JP 05-10211 2/1993
JP 2000-43818 2/2000
WO WO00/71422 11/2000

* cited by examiner

VACUUM PACKAGING APPLIANCE WITH VACUUM SIDE CHANNEL LATCHES

CROSS-REFERENCE TO RELATED APPLICATIONS

The present application claims priority to Baptista's provisional patent application 60/450,528, entitled "Vacuum Packaging System with a Secondary Vacuum Latching Mechanism," and Baptista's provisional patent application 60/450,295, entitled "Vacuum Packaging System with Removable Trough," both filed Feb. 27, 2003, and incorporated herein by reference. The present application is related to Baptista's utility patent application entitled "Vacuum Packaging Appliance with Removable Trough" filed herewith, and incorporated herein by reference.

TECHNICAL FIELD

The present invention relates to home vacuum packaging appliances. In particular, the present invention teaches a vacuum packaging appliance with at least one vacuum latch for ease of maintaining closure of the appliance during a vacuum packaging process.

BACKGROUND OF THE INVENTION

Various appliances and methods are used for the purpose of vacuum packaging and sealing plastic bags and containers to protect perishables, such as foodstuffs, and other products against oxidation. Conventional commercial devices and some consumer appliances are generally expensive to manufacture, complex in construction and/or cumbersome to operate. One conventional type of vacuum sealing system, primarily used for commercial packaging purposes, includes a vacuum chamber in which the entire packaged product is placed, along with heat sealers and attendant components of the system.

Another type of conventional vacuum sealing system uses a vacuum nozzle that is inserted within a plastic bag for evacuation purposes. Although adaptable for low-volume home use, this type of system is cumbersome to use and normally requires a liquid separator or filter to prevent liquids or powders, retained within the bag, from being drawn into a vacuum pump connected to the nozzle. Further, the heat sealer employed therein must be closely calibrated and synchronized with the positioning and withdrawal of the vacuum nozzle from the bag.

Still another known vacuum sealing system places a portion of a bag, containing a product to be packaged, in a first vacuum chamber and extends an open end or neck of the bag into a second vacuum chamber. The first vacuum chamber is then evacuated to expand the neck of the bag to isolate the chambers from each other. Then a vacuum is drawn in the second vacuum chamber to evacuate the bag. Thus, isolation of the two chambers from each other, during evacuation of the second vacuum chamber, is dependent on the physical properties composing the neck of the bag (which is intended to form a static seal between the two chambers) and very close synchronization and calibration of the evacuation and sealing procedures and controls therefor. A vacuum sealing system of this type is disclosed in U.S. Pat. No. 3,928,938, for example.

U.S. Pat. No. 2,778,171 discloses another vacuum sealing system, which is not believed to have been commercialized. In particular, the open end of a plastic bag is placed between a pair of jaws or between a lower jaw and a flexible sheet to evacuate the bag that is then heat-sealed. An inner surface of the bag has protuberances that make point contact with an opposite surface of the bag to define air exhaust passages during evacuation of the bag. More recent successfully marketed appliances are described in U.S. Pat. No. 4,941,310, the complete contents of which is incorporated herein by reference.

During operation of the home vacuum packaging appliance, the user must be provided a mechanism for maintaining the integrity of the vacuum circuit. Typically this is accomplished by requiring the user to manually depress on a lid of the home vacuum packaging appliance and maintain pressure while the bag or container is evacuated. What is needed is a simpler and more reliable mechanism for maintaining the integrity of the vacuum circuit during operation of the vacuum packaging appliance.

DETAILED DESCRIPTION

The present invention teaches a variety of vacuum packaging appliances for making an evacuated and hermetically sealed container. In order to assist with maintaining the integrity of a vacuum circuit used for evacuating the container, the present invention teaches mechanisms and techniques for providing a vacuum latch which during operation tends to engage a lid and a base of the vacuum packaging appliance.

Figure 1:
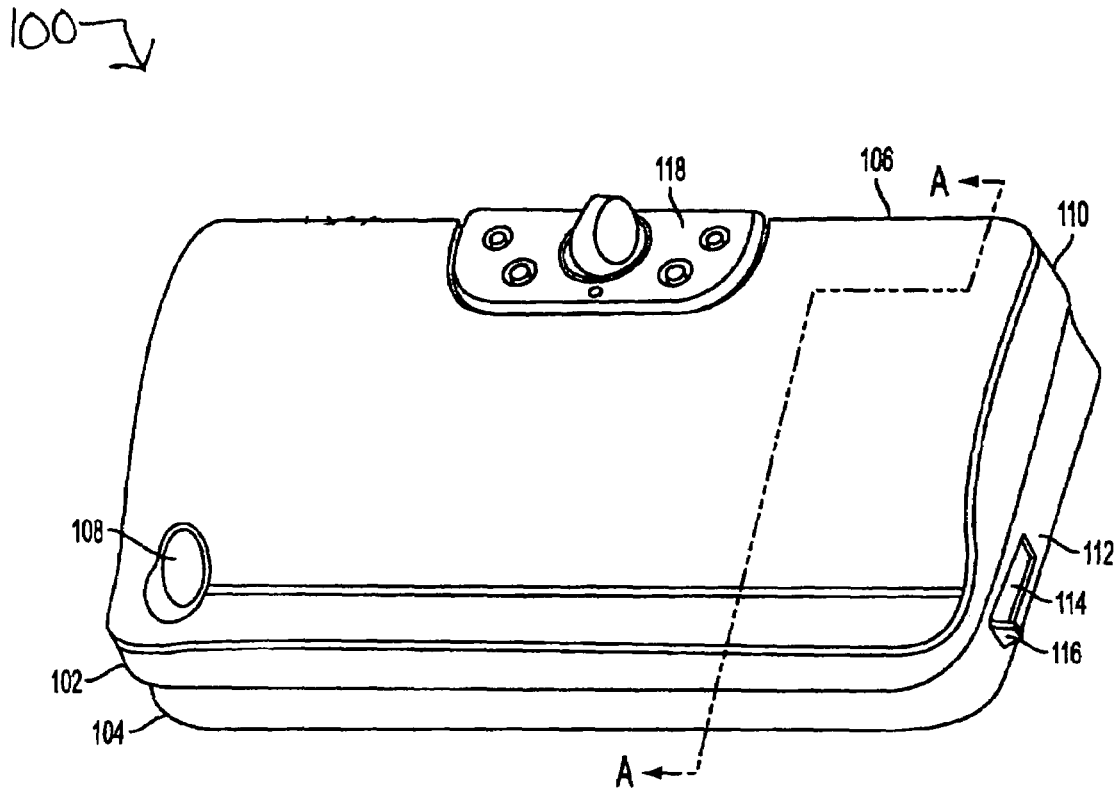
FIG. 1 is an isometric view of an embodiment of the vacuum packaging appliance of the invention with the lid in a closed position.

FIG. 1 shows a vacuum packaging appliance 100 for vacuum packaging and sealing articles in a container. The appliance 100 has a lid 102 and a base 104. In the embodiment shown in FIG. 1, the lid 102 and base 104 are pivotally connected at a backside 106 of the appliance 100. However, in alternate embodiments the lid and base are connected in any other convenient manner or they may be independent parts. In any event, the lid 102 and the base 104 engage in a manner that couples the container into a vacuum circuit of the appliance 100.

In the embodiment shown in FIG. 1, the lid includes a blade handle 108 that is associated with a blade (not shown) on the inside of the lid 102 of the appliance 100. The blade handle 108 is slideably engaged within a slot 110 that extends substantially the entire length of the appliance 100. Although the embodiment shown in FIG. 1 includes a blade handle 108 and associated blade (not shown) slideably coupled in a slot 110 in the lid 102 of the appliance 100, in alternate embodiments the blade handle 108, blade (not shown) and slot 110 may have various other configurations. Furthermore, in alternate embodiments, the device may not have a blade handle 108, blade (not shown) or slot 110. The blade is for cutting sections of flexible bag material used to form the container.

FIG. 1 also shows the base 104 of the appliance 100 including an aperture 112 that is covered by a door 114. In the embodiment shown in FIG. 1, the door 114 is slideably mounted in the interior of the base 104 and includes a protrusion 116 that allows a used to more easily slide the door 114 between an open and a closed position. In alternate embodiments, the door 114 may take any convenient form and may be mounted to the appliance 100 in any convenient manner.

The appliance 100 shown in FIG. 1 includes a control panel 118 that is coupled with the base 104 and extends above the lid 102. In alternate embodiments, the control panel may be located in any convenient location on the appliance or may not be included.

Figure 2:
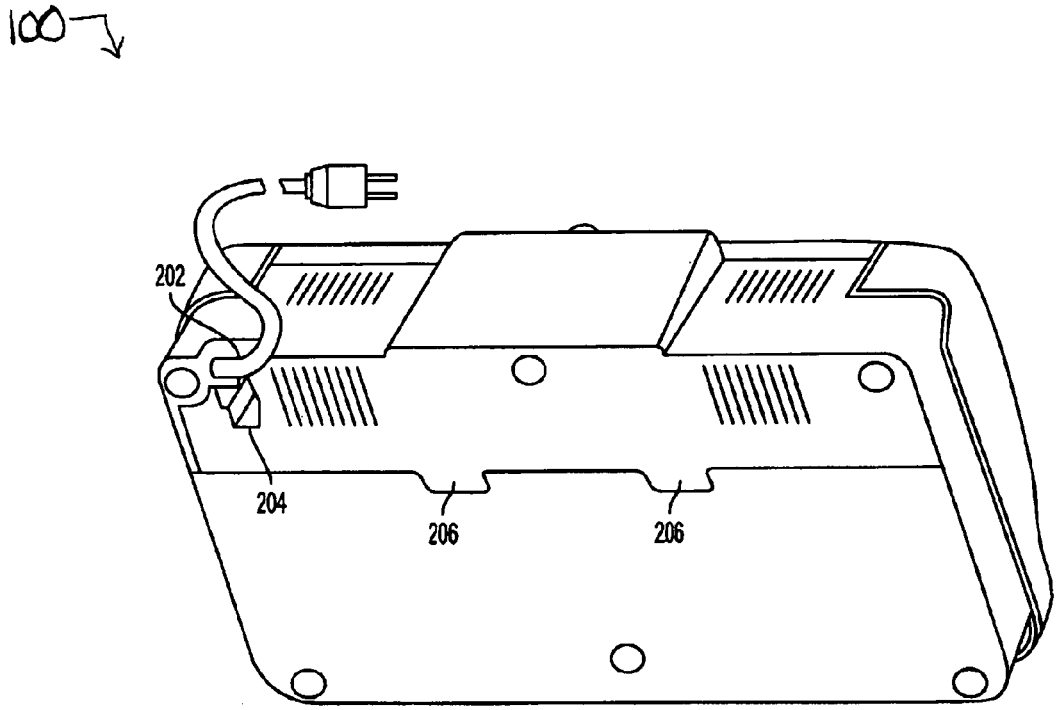
FIG. 2 is an isometric view of the underside of the appliance shown in FIG. 1.

FIG. 2 is an isometric view of the underside of the appliance 100. FIG. 2 shows that the appliance 100 includes an alternating current (AC) power cord 202 that is coupled with the base 104. However in alternate embodiments, the power cord 202 maybe coupled with any convenient part of the appliance 100 or may not be present. In still further alternate embodiments, the device may be powered by any convenient source such as one or more batteries providing direct current (DC) or various other known energy transfer technologies.

In the embodiment shown in FIG. 2, the base 104 has a recess 204 for storage of the power cord 202. To at least partially retain the power cord in the recess 204, the base also includes cord retention flanges 206. In the embodiment shown in FIG. 2, two of the chord retention flanges 206 are rotatably coupled with the base 104 of the appliance 100 and one chord retention flange 206 is fixed relative to the base 104. The rotatable chord retention flanges 206 allow a user to more easily store the power chord in the recess 204. However, in alternate embodiments any or all of the chord retention flanges 206 may all be fixed or rotatable or may not be present. In still further alternate embodiments, the recess 204 may take any convenient shape or may not be present.

Figure 3:
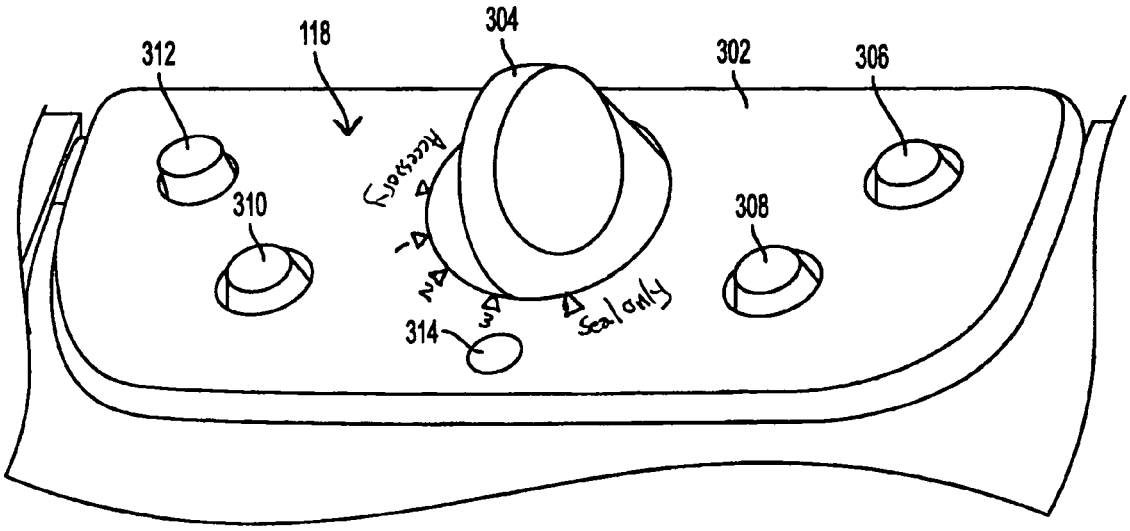
FIG. 3 is an expanded isometric view of the control panel of the appliance shown in FIG. 1.

FIG. 3 is a magnified view of the control panel shown in FIG. 1. In the embodiment shown in FIG. 3, the control panel 118 has a face plate 302 that is removably coupled with the base 104. The faceplate 302 is removable to facilitate cleaning of the appliance 100 and so that the appliance 100 maybe manufactured with various faceplates that can accommodate a greater or fewer number of openings for controls. Although the embodiment in FIG. 3 is shown with a removable faceplate 302, in alternate embodiments the face plate 302 my be fixed or may be integral with the base 104 or any other portion of the appliance 100.

In the embodiment shown in FIG. 3, the control panel 118 has rotary dial control 304, a cancel control 306, an instant seal control 308, a extended vacuum control 310, an accessory port 312 and an indicator light 314. However in alternate embodiments, various other controls may be included in the control panel 118 and/or various controls may be excluded from the control panel 118.

In the embodiment shown in FIG. 3, the rotary dial 304 has multiple positions that can control various aspects of the appliance 100. FIG. 3 shows that the rotary dial 304 has five positions: Accessory, 1, 2, 3 and Seal Only. However in alternate embodiments, the rotary dial may have more or fewer settings that can control various aspects of the appliance 100. When the rotary dial 304 is in the accessory position, the accessory port 312 is activated and accessories (not shown) can be attached to the appliance 100 either directly or via a vacuum hose (not shown). When the rotary dial 304 is in any position other than the accessory position, the accessory port 312 is sealed off and a vacuum is not drawn through the accessory port 312. Sealing off of the accessory port 312 can be accomplished by other convenient mechanism.

Figure 4:
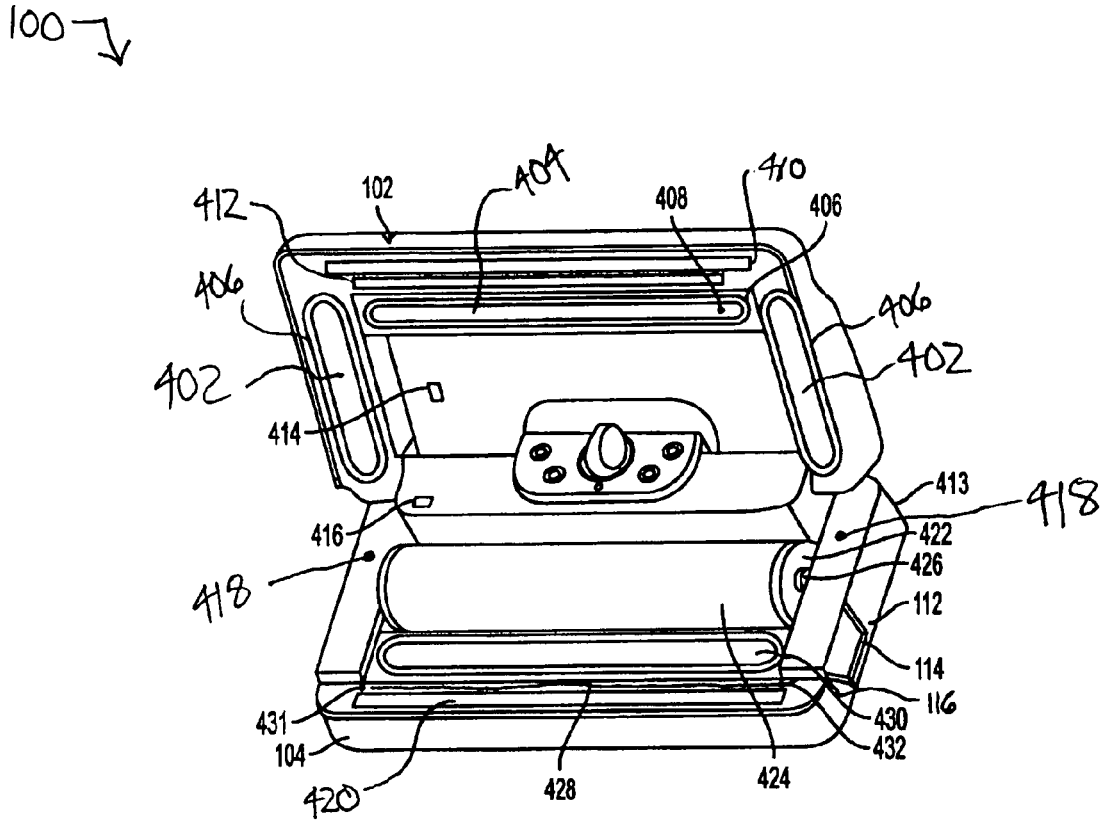
FIG. 4 is an isometric view of the appliance shown in FIG. 1 with the lid in an open position.

Positions 1, 2 and 3 allow the a user to control the length of time the sealing mechanism (not shown) is active. In one embodiment, the position 1 may active the sealing mechanism for a first predetermined period, position 2 may activate the sealing mechanism for a second predetermined period, and position 3 may activate the sealing mechanism for a third predetermined period. Thus, the user can select the duration of the sealing process. The seal only position allows a user to operate the sealing mechanism 420 (FIG. 4) without requiring evacuation of the primary evacuation chamber 404 (FIG. 4).

Although the appliance shown in FIG. 3 includes a rotary dial 304 with five positions, in alternate embodiments the appliance can include a rotary dial 304 that has more or fewer positions. In still further alternate embodiments, the appliance may not include a rotary dial 304 or can include various buttons or other control mechanisms to control the various operations of the appliance 100. Furthermore, it will be appreciated that the present invention contemplates a host of heat-sealing strategies not described according to the illustrations. For example, the heat sealing-mechanism may be controlled by a feedback device (electrical current, temperature, variable resistance, etc.) which may control the heating-sealing time. The type of container, the contents of the container, etc., are all factors that may be taken into consideration when controlling the heat-sealing process.

As shown in FIG. 3, the control panel includes a cancel button 306. The cancel button 306 allows a user to cancel a vacuum operation or sealing operation at any time during the operation. In the embodiment shown in FIG. 3, the cancel button 306 is an electro-mechanical press-type switch. However, in alternate embodiments the cancel button 306 may be any type of user-activated control mechanism and/or the appliance may not include a cancel button 306.

In embodiment shown in FIG. 3, the control panel 118 includes an instant seal button 308. The instant seal button 308 allows a user to terminate the evacuation process and begin the sealing process at any time during operation of the appliance 100. By way of example, a user may desire to only partially evacuate a container or not evacuate a container at all. Thus, the user may engage the container in the device and seal the container either without drawing a vacuum in the container or while drawing a vacuum in the container before the device begins automatically sealing the container. FIG. 3 depicts the instant seal button 308 as an electro-mechanical press-type switch. However, in alternate embodiments the instant seal button 308 may be any type of user-activated control mechanism and/or the appliance may not include an instant seal button 308.

FIG. 3 also shows that the control panel 118 includes an extended vacuum button 310. In the embodiment shown in FIG. 3, the extended vacuum button 310 allows a user to extend the length of time for which the container (not shown) is evacuated. In one embodiment, if a user depresses the extended vacuum button 310 during the evacuation process, the container will continue to be evacuated for an additional predetermined amount of time after a first predetermined vacuum strength is reached. In an alternate embodiment, if a user depresses the extended vacuum button 310 during the evacuation process, the container will continue to be evacuated until the vacuum strength reaches a second predetermined strength. In a still further alternate embodiment, if a user depresses the extended vacuum button 310 during the evacuation process, the container will continue to be evacuated until either the vacuum strength reaches a second predetermined strength or until a predetermined time has expired after the vacuum strength reached a first predetermines vacuum strength. Although FIG. 3 depicts the extended vacuum button 310 as a press-type electro-mechanical switch, in alternate embodiments the extended vacuum button 310 may be any type of control mechanism and/or the appliance 100 may not include an extended vacuum button 310.

In the embodiment shown in FIG. 3, the control panel 118 includes a accessory port 312. The accessory port allows a user to connect the appliance to various containers as described in U.S. Pat. No. 4,491,310, by Hanns J. Kristen, issued Jul. 17, 1990, and assigned to the same assignee as this patent, the complete contents of which is incorporated herein by reference.

The control panel 118 shown in FIG. 3 also includes an indicator light 314. The indicator light 314 serves to notify a user of the status of the appliance 100. In the embodiment shown in FIG. 3, the indicator light is off when the device is inactive, solid green while the device is actively evacuating a container and emits intermittent green flashes when the device is sealing a container (not shown). However, in alternate embodiment the light may emit light of various colors and/or intensifies and/or at various intervals to indicate various operations that the machine is performing. For example, the indicator light 314 may flash amber or some other color to indicate that the device is currently drawing an extended vacuum or the indicator light 314 may glow red to indicate that the accessory port 312 is active. In still further alternate embodiments, the control panel 118 may not include an indicator light 314.

FIG. 4 is an isometric view of the appliance 100 shown in FIG. 1 with the lid 102 in an open position. In the embodiment shown in FIG. 4, the lid 102 of the appliance 100 includes two pneumatic latch chambers 402 and a primary evacuation chamber 404. Each of the pneumatic latch chambers 402 and the primary evacuation chamber 404 have flexible gaskets 406 at their perimeters. Additionally, the primary evacuation chamber 404 includes an evacuation port 408 that is coupled to a vacuum source (not shown) housed inside the appliance 100. In the embodiment shown in FIG. 4, the lid also includes a sealing gasket 410, a cutting mechanism 412 that includes the handle 100 and the blade (not shown) and a protrusion 414.

The base 104 of the appliance 100 shown in FIG. 4 includes an electro-mechanical switch 416, evacuation apertures 418, and a thermal sealing mechanism 420. In the embodiment shown in FIG. 4, the electro-mechanical switch 416 is positioned on the base such that when the lid 102 is in a closed position, the protrusion 414 is substantially vertically aligned with the electro-mechanical switch 416. Thus, when the lid 102 is in a closed position and then is further depressed, the protrusion 414 can actuate the electro-mechanical switch 416 and activate the appliance 100. Of course, this switching control mechanism is optional and may be accomplished through an optical switch, etc.

The base 104 of the appliance 100 shown in FIG. 4 has a recess 422 that is adapted to hold container material 424. In the embodiment shown in FIG. 4, the container material 424 is a roll of flattened, tubular container material and is supported on rotational supports 426. The rotation supports 426 are designed to engage the ends of the roll of container material 424 and rotate freely within the recess 422. In the embodiment shown in FIG. 4, each rotation support 426 has grooves at its perimeter to facilitate rotation of the rotational support 426 and the roll of container material 424. The embodiment shown in FIG. 4 includes a recess 422 and a roll of container material 424 mounted on rotation supports 426. In alternate embodiments the appliance 100 may not include storage space for a roll of container material 424. The container material 424 can be mounted on a central spindle (not shown) and/or mounted using any other convenient mechanism. In a still further alternate embodiment, the roll or container material 424 may simply be place or stored in the recess 422 without any support mechanism to facility dispensing the container material 424.

In the embodiment shown in FIG. 4, the roll of container material is a single roll of continuously bonded plastic as described in U.S. Pat. No. RE34,929, by Hanns J. Kristen, issued May 9, 1995 a reissue patent based on U.S. Pat. No. 4,756,422, by Hanns J. Kristen, issued Jul. 12, 1988, assigned to the assignee of the present application, the complete contents of which is incorporated herein by reference. However, in alternate embodiments, the roll of container material 424 may be any convenient material.

The base 104 of the appliance 100 shown in FIG. 4 also includes a groove 428 that is located between the thermal sealing mechanism 420 and a trough 430. The groove 428 is positioned in the base 104 such that when the lid 102 is in a closed position, the cutting mechanism 412 is substantially vertically aligned with the groove 428. In operation, a user can move the handle 108 on the lid 102 within the slot 110 which will cause the cutting mechanism 412 to travel within the groove 428. When container material is present within the groove 428, the container material will be cut by the cutting mechanism 412.

In the embodiment shown in FIG. 4, the cutting mechanism 412 is a safety cutting mechanism designed to reduce the risk of injury to a user. However in alternate embodiments, the cutting mechanism can be any convenient cutting mechanism. Although the embodiment shown in FIG. 4 includes a cutting mechanism 412 and associated components, in alternate embodiments, the cutting mechanism 412, the groove 428, the handle 108 and the slot 110 can have various other convenient forms or may not be present.

The thermal sealing mechanism 420 includes one or more electrically conductive wires (not shown) that produce heat when a voltage differential is applied across the length of the wire. In the embodiment shown, the electrically conductive wires (not shown) are covered with a Teflon tape. However, in alternate embodiments, the wires may be exposed or wrapped in a material. When the lid 102 is in a closed position, the sealing gasket 410 presses against the sealing mechanism 420. If the sealing mechanism 420 is activated and container material 424 is disposed between the sealing gasket 410 and the sealing mechanism 420, the container material 424 can be hermetically sealed. Although the appliance 100 is described as including a sealing mechanism 420 that is integrated with the appliance, in alternate embodiments, the sealing mechanism 420 maybe an external appliance or may not be included. Additionally in alternate embodiments, various other sealing mechanisms 420 may be used to seal the container material 424, such as crimping or external clamps.

In operation, when the lid 102 is in a closed position and is depressed such that the protrusion 414 actuates the electro-mechanical switch 416, the vacuum source (not shown) is activated. In the embodiment shown in FIG. 4, the vacuum source first draws a vacuum in the latch chambers 402 via evacuation apertures 418. The evacuation of the latch chambers 402 draws the lid 102 down towards the base 104. Once the vacuum strength in the latch chambers 402 reaches a predetermined level, evacuation of the latch chambers 402 ceases and the vacuum source begins to evacuate the primary evacuation chamber 404 which is mated with the trough 430.

Alternatively, after a predetermined time, vacuum to the primary evacuation chamber can be applied before vacuum is cut off to the latch chambers 402. In a still further alternate embodiment, vacuum to the latch chambers 402 can be reduced in a step down manner as vacuum is being applied to the primary evacuation chamber 404 in a step-up manner. Evacuation of the primary evacuation chamber 404 and trough 430 is performed via the evacuation port 408. In FIG. 4, when the lid 102 is in a closed position, the gasket 406 surrounding the primary evacuation chamber 404 and the gasket 406 surrounding the trough 430 are substantially vertically aligned such that a substantially contained environment is formed by the primary evacuation chamber 404 and the trough 430.

In an alternate embodiment, the vacuum source may evacuate the latch chambers 402 for a fixed period of time instead of until a predetermined vacuum strength is reached. Additionally, in still further alternate embodiments, the latch chambers maybe associated with a vacuum source independent from the vacuum source associated with the primary evacuation chamber 408. In still further alternate embodiments, each latch chamber 402 can be associated with an independent vacuum source.

While in the embodiment shown in FIG. 4 the appliance 100 is shown having two latch chambers positioned at the outer boundaries of the appliance 100, in alternate embodiments there maybe greater or fewer latch chambers 402 and they maybe positioned in any convenient location on the appliance. Additionally, while the evacuation apertures 418 are shown as being located in the base 104, in alternate embodiments the evacuation apertures 418 can be located in any convenient location which will allow evacuation of the latch chambers 402. Furthermore, the evacuation chambers 402 can have any convenient shape.

In the embodiment shown in FIG. 4, for cleaning purposes, the trough 430 is removable from the base 104 of the appliance 100 through the aperture 111 when the door 114 is in an open position. In the embodiment shown in FIG. 4 the door 114 is manually slideable between an open and a closed position. However, in alternate embodiments, the door can be mechanically operated and/or can open in any convenient fashion. In still further alternate embodiments, the door 114 may not be present.

In operation, a user inserts an open end of a container, such as a flexible bag, into the trough 430 or attaches a container to the accessory port 312. The user then selects a setting on the rotary dial 304, closes the lid 102 and depresses the lid 102 past the closed position to actuate the electro-mechanical switch 416 with the protrusion 414. The vacuum source will then evacuate the latch chambers 402 to hold the lid 102 relative to the base 104. Once the lid 102 is secured relative to the base 104 by the latch chambers 402, the primary evacuation chamber 404 and the trough 430 are evacuated thus evacuating the open container inserted into the trough 430. When the vacuum strength reaches a predetermined level, the sealing mechanism will be activated to seal the container, if it is inserted into the trough 430. The evacuated and scaled container may then be released from the appliance 100.

Figure 5:
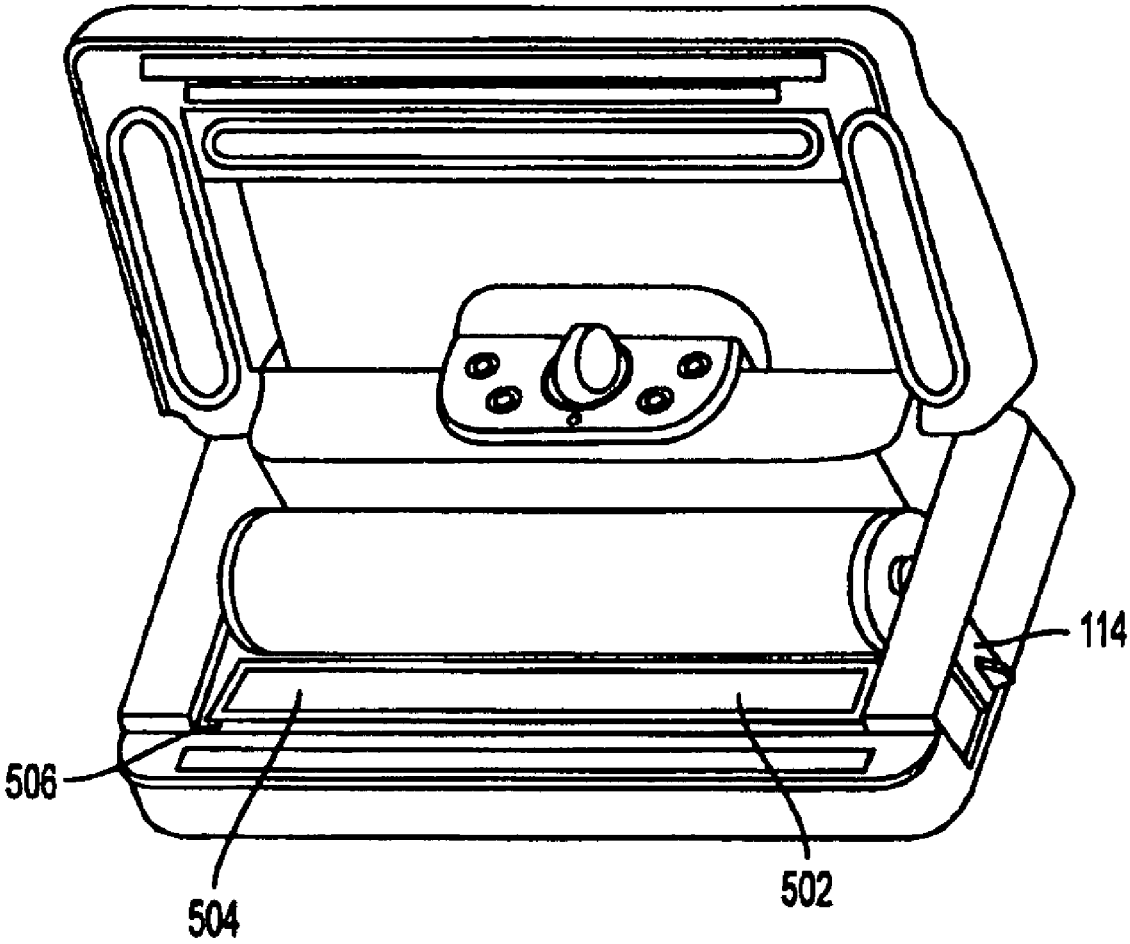
FIG. 5 is an isometric view of the appliance shown in FIG. 1 with the lid in an open position and with the trough removed from the appliance.

FIG. 5 is an isometric view of the appliance shown in FIG. 4 with the trough 430 removed and the door 114 in an open position. The embodiment shows a recess 502 in which the trough 430 may be inserted and removed.

In the embodiment shown in FIG. 5, the recess has retention flanges 504 that are designed to prevent substantial vertical and rotational movement of the trough 430 within the recess 502 when the trough 420 is inserted in the recess 502. While the embodiment shown in FIG. 5 includes retention flanges 504, in alternate embodiments the recess may use any convenient mechanism to restrict movement of the trough 430 when it is inserted in the recess 502. Furthermore in alternate embodiments, the recess 502 may not have any mechanism for restraining vertical and/or rotational movement of the trough 430 within the recess 502.

In the embodiment shown in FIG. 5, the recess 502 has a slot 506 at the end of the recess 502 opposite the door 114. The slot 506 is designed to mate with a protrusion in the trough 430 in a snap-fit manner. The snap-fit mating of the slot 506 and the recess in the trough 430 is designed to restrict horizontal movement of the trough 430 within the recess 502. In alternate embodiments the recess 502 can includes alternate and/or additional mechanisms to inhibit movement of the trough within the recess 502. Additionally instill further alternate embodiments, the appliance 100 may not include any mechanisms to inhibit horizontal movement of the trough 430.

Figure 6:
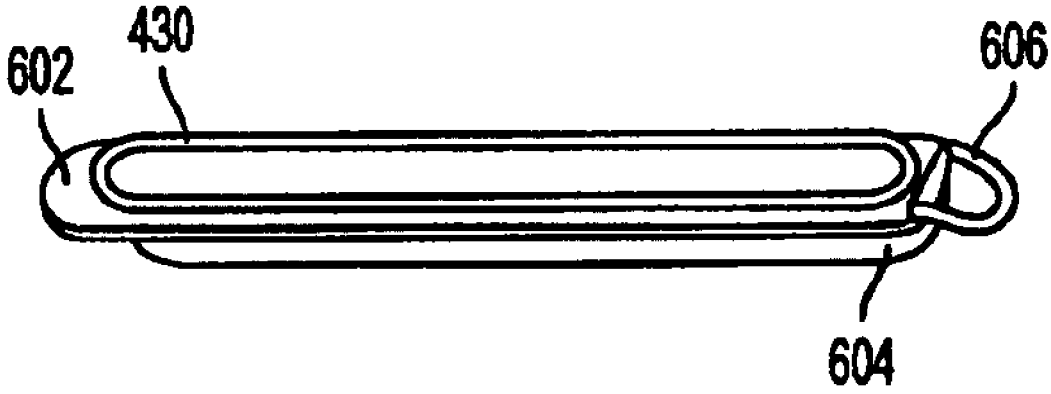
FIG. 6 is an isometric view of the trough removed from the appliance.

FIG. 6 is an isometric view of the trough 430 when removed from the vacuum packaging appliance 100. In the embodiment shown in FIG. 6, the trough 430 includes an extension that includes a protrusion 602. The protrusion 602 is designed to mate with the slot 506 in a snap-fit manner. Although the embodiment shown in FIG. 6 includes an extension with a protrusion 602, in alternate embodiments other convenient mechanisms may be used and/or the trough 430 may not include a movement inhibiting mechanism.

The embodiment shown in FIG. 6 includes flanges 604 that, as described with reference to FIG. 5, are designed to engage with the retention flanges 504. Although the embodiment shown in FIG. 6 includes retention flanges 604, in alternate embodiments other convenient mechanisms may be used and or the trough 430 may not include a movement inhibiting mechanism.

The embodiment shown in FIG. 6 includes a handle 606. The handle is included to facilitate removal and insertion of the trough 430. Although the embodiment shown in FIG. 6 depicts the handle as an open type loop, any convenient handle shaper may be used. Additionally in alternate embodiments, the through 430 may not include a handle.

Figure 7:
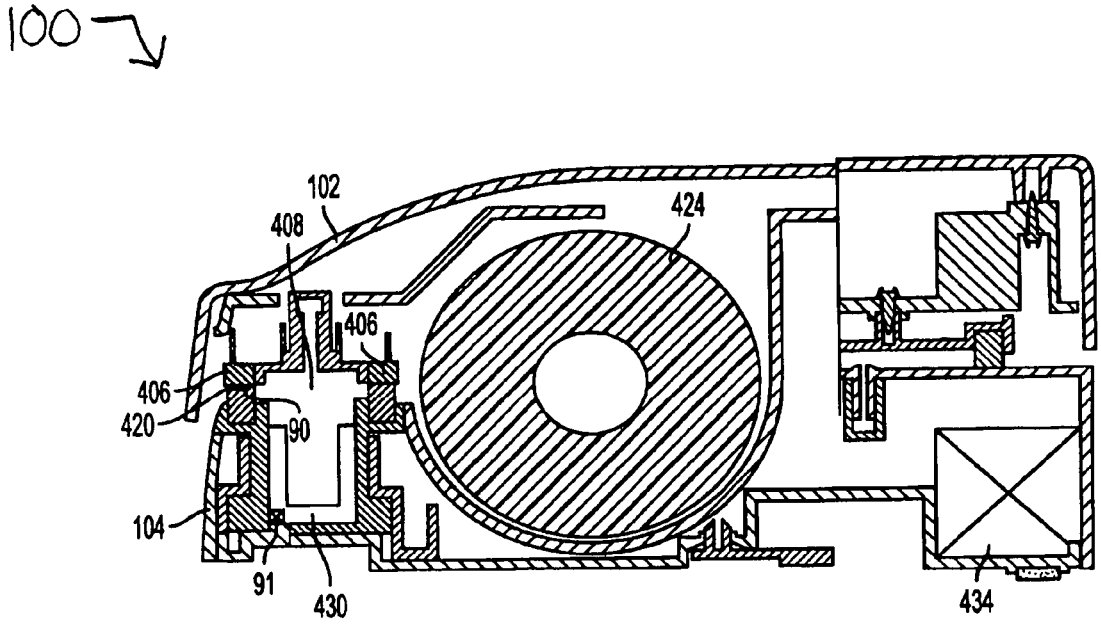
FIG. 7 is transverse cross-sectional view of the device shown in FIG. 1.

FIG. 7 is a sectional view of the appliance 100, cut along the section line A—A indicated in FIG. 1. The embodiment shown in FIG. 7 shows the lid 102 in a closed position relative to the base 104. The base 104 includes the thermal sealing mechanism 420 which is positioned in substantial vertical alignment with the sealing gasket 410 in the lid 102 of the appliance.

In the embodiment shown in FIG. 7, the trough 430 is mounted in the recess 502 such that the flanges 604 of the trough 430 are positioned below the retention flanges 504 of the recess 502. Thus, vertical movement of the trough 430 with the recess 502 is substantially inhibited.

The embodiment shown in FIG. 7 also shows that the base of the appliance 100 includes a recess 204 and rotatably mounted chord retention flanges 206. The embodiment shown in FIG. 7 also depicts a roll of container material 424 that is stored within the recess 422 within the appliance 100.

The embodiment shown in FIG. 7 also shows that when the lid 102 is in a closed position related to the base 104, the gaskets 406 surrounding the primary evacuation chamber 408 and the trough 430 are in substantial vertical alignment and are in contact. The chamber 408 and the trough 430 thus define a signal evacuable space. Additionally, the embodiment shown in FIG. 7 shown that the slot 110 in the lid 102 is in substantial vertical alignment with the groove 428 in the base 104, thus allowing the cutting mechanism (not shown) to cut container material contained in the groove 428.

The vacuum source or sources (not shown) may be contained in any convenient location within the appliance 100 or in alternate embodiments may be external to the appliance 100. Although the vacuum source described in the present invention is described as a piston type vacuum, the vacuum source may be any convenient mechanism capable of drawing a vacuum.

Figure 8:
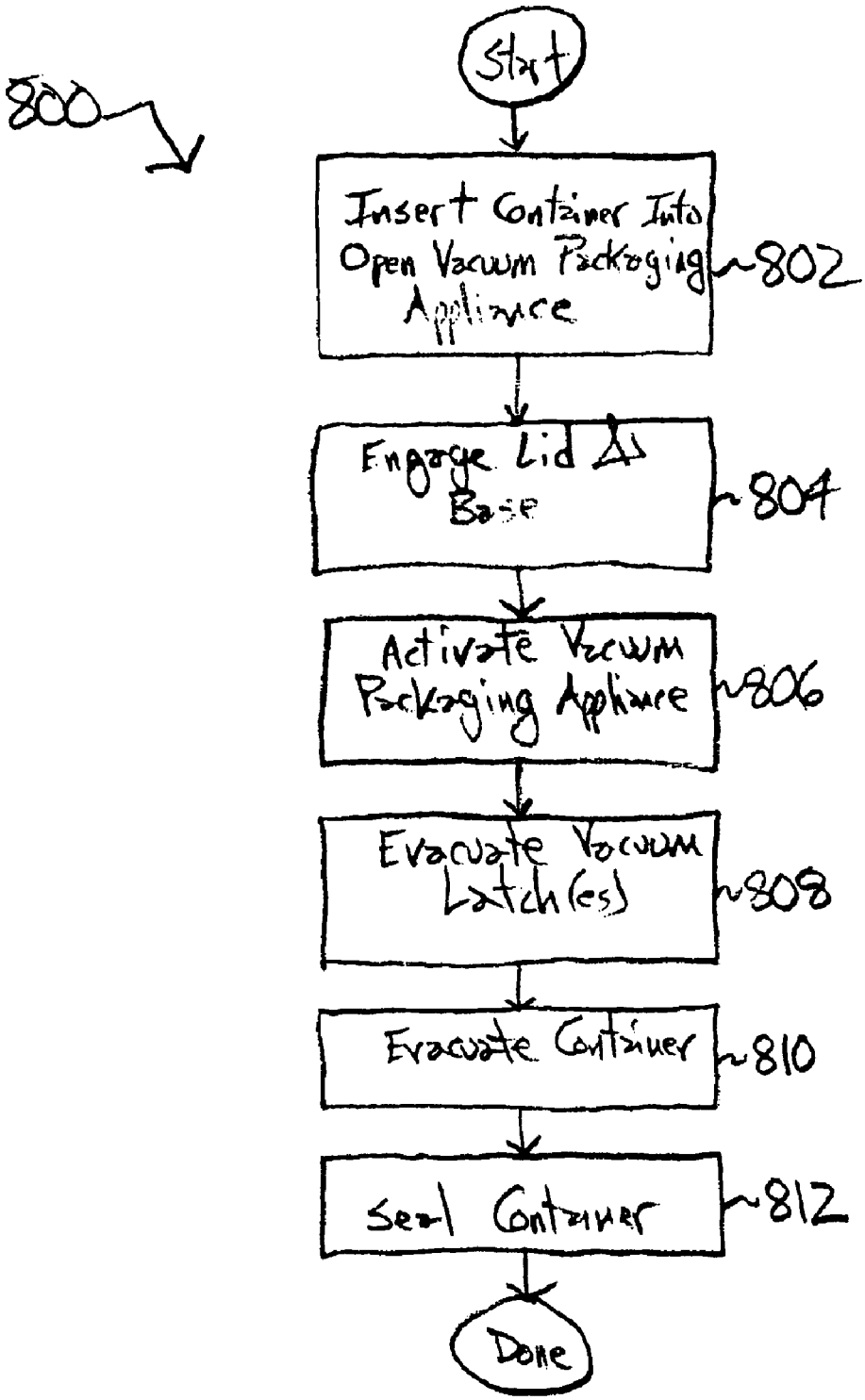
FIG. 8 is a flow chart illustrating a method of forming a hermetically sealed vacuum packaging container in accordance with one aspect of the present invention.

Turning next to FIG. 8, a method 800 of forming a hermetically sealed vacuum packaged container from an open container using a vacuum packaging appliance will now be described. As will be appreciated, the method of the present invention can be used with any suitable vacuum packaging appliance. Accordingly, flow reference numbering as used in the above FIGS. will not be used with reference to FIG. 8 unless merely for example.

In any event, the method 800 begins with required initialization steps. For example, a user may take packaging material and form seals on all but three sides. This could be done with use of the roll of bag material 424, or may be done by obtaining preformed bags. These are not specifically shown In any event, in a step 802, the user inserts an open end of a container into the vacuum packaging appliance in order to begin forming a vacuum circuit with the vacuum packaging appliance. This may involve placing the open end into a drip trough, etc. In a next step 804, the operatively engages the lid and the base of the vacuum packaging appliance. As will be appreciated from the above discussion, engaging the lid and base closes the vacuum circuit formed by the container, the vacuum chamber(s) and the vacuum source. However, to provide a sufficient seal to evacuate the container via the vacuum circuit, a certain amount of pressure or force must be applied to maintain engagement of the lid with the base.

In a step 806, the user activates the vacuum packaging appliance. This activation 806 could be triggered by a variety of actions. For example, activation could be initiated by the user engaging the lid and the base. Alternatively, the user may first engage the lid and base, and then activate (through switch or button, etc.) the device. This activation may include one step for forming the vacuum latch, and then another for evacuation of the container.

In a step 808, a vacuum latch is formed between the lid and the base. The vacuum latch evacuation process could result in latch evacuation for a preset period of time, for a time as determined by the user, or until a certain sensed vacuum level is reached. As will be appreciated, using a process which evacuates the vacuum latch chambers described above would work well to form a vacuum latch between the lid and base. However, the present invention also contemplates other vacuum latch mechanisms. For example, a mechanical latch could be coupled to the vacuum circuit such that operation of the vacuum source causes the mechanical latch to provide the necessary tension of engagement between the lid and the base.

In a step 810, the container is evacuated in order to form a vacuum. Container evacuation can be accomplished through any suitable method as desired by the particular application. For example, the user may control container evacuation. Alternatively, container evacuation could begin automatically a set time period after latch evacuation or after the vacuum latch reaches a set vacuum level.

In a step 812, the container is sealed thereby forming a hermetically sealed vacuum packaging container. As will be appreciated, this sealing is often accomplished through a heat-sealing mechanism applied to the container. This heat-sealing mechanism can be engaged in any suitable manner; e.g., after a certain period of container evacuation or after a certain level of vacuum is reached within the container. In any event, once the container is sealed, the method 800 is complete.

It will be understood by those skilled in the art that the above-presented description is provided by way of example only and is not intended to be limiting in any way. Those skilled in the art will readily understand that numerous other embodiments of the invention are contemplated and possible which meet the scope and spirit of the invention.

What is claimed is:

1. A vacuum packaging appliance for evacuating a container, said vacuum packaging appliance comprising:

a base defining an upper support surface adapted to receive an open end of said container;

a lid operatively associated with said base, said lid and said base defining a vacuum chamber there between to receive said open end of said container;

at least one gasket surrounding said vacuum chamber for directly engaging said container such that said open end of said container is operatively associated with said vacuum chamber;

a vacuum source operatively associated with said vacuum chamber for selectively evacuating said vacuum chamber and said operatively associated container;

a vacuum latch chamber; and a vacuum latch for restraining movement of said base relative to said lid when said vacuum packaging appliance is in use and said vacuum latch includes a latch gasket formed into said vacuum latch chamber such that said latch gasket forms a seal between said lid and said base when said lid and said base are engaged.

2. A vacuum packaging appliance as recited in claim 1, wherein said vacuum latch chamber is formed in said lid.

3. A vacuum packaging appliance as recited in claim 1, wherein said vacuum latch chamber is formed in said base.

4. A vacuum packaging appliance as recited in claim 1, wherein said latch gasket is removable from said vacuum latch chamber.

5. A vacuum packaging appliance as recited in claim 1, wherein said vacuum latch is coupled with said vacuum source such that when said vacuum source is activated, said vacuum latch chamber is operatively associated with said vacuum source.

6. A vacuum packaging appliance as recited in claim 5, wherein said vacuum latch chamber is formed into said vacuum packaging appliance via a spring attachment thereby facilitating mating of said vacuum latch chamber in forming a seal.

7. A vacuum packaging appliance as recited in claim 1, wherein said vacuum latch is coupled to a second vacuum source.

8. A vacuum packaging appliance for use in evacuating a container, said vacuum packaging appliance comprising:

a vacuum source;

a base defining an upper support surface and including a trough, said upper support surface and said trough adapted to receive an open end of said container, said trough useful for capturing liquids and contaminants removed from said container during operation of said vacuum packaging appliance;

a lid operatively associated with said base, said lid and trough defining a vacuum chamber there between to receive said open end of said container, said vacuum chamber operatively coupled with said vacuum source; and a vacuum latch including a vacuum latch chamber formed in said lid, said vacuum latch being distinct from said vacuum chamber, which through a vacuum latching mechanism tends to maintain a coupling of said base and said lid, as well as a vacuum integrity of said vacuum chamber, during operation of said vacuum packaging appliance; wherein said vacuum packaging appliance further comprises a heat sealing mechanism arranged to heat seal said open end of said container;

said trough is removable from said vacuum packaging appliance, thereby tending to ease emptying and cleaning of said trough;

said trough coupled to said base via a tongue and groove such that a user may remove said trough by pulling said trough in a sliding motion out from said base;

said trough has a handle for ease of pulling said trough from said base;

said handle of said trough can be hidden behind a door in said base, said trough only removable when said door is open; and said vacuum latch includes a latch gasket formed into said vacuum latch chamber such that said latch gasket forms a seal between said lid and said base when said lid and said base are engaged.

* * * * *